United States Patent [19]

Millevoi

[11] 4,063,400

[45] Dec. 20, 1977

[54] CONTINUOUS FILM SEALING MACHINE

[75] Inventor: Eugenio Millevoi, Fort Lee, N.J.

[73] Assignee: Weldotron Corporation, Piscataway, N.J.

[21] Appl. No.: 735,035

[22] Filed: Oct. 22, 1976

[51] Int. Cl.[2] ..... B65B 51/30

[52] U.S. Cl. ..... 53/180 R; 53/77

[58] Field of Search ..... 53/180 R, 180 M, 182 R, 53/182 M

[56] References Cited

U.S. PATENT DOCUMENTS 3,237,371 3/1966 Gerlach ..... 53/182 R 3,465,489 9/1969 Monaghan ..... 53/182 R X

*Primary Examiner*—Travis S. McGehee

[57] ABSTRACT

The machine includes a horizontal operating table and various apparatus associated therewith for performing different functions. The apparatus includes, as a first portion of the operating table, a product in-feed conveyor, a supply of film and bag-forming means, bag-sealing means including means for operating sealing bars to form a seal and simultaneously moving the packaged product along the table to an out-feed conveyor. The invention is particularly concerned with the bag-sealing means.

7 Claims, 10 Drawing Figures

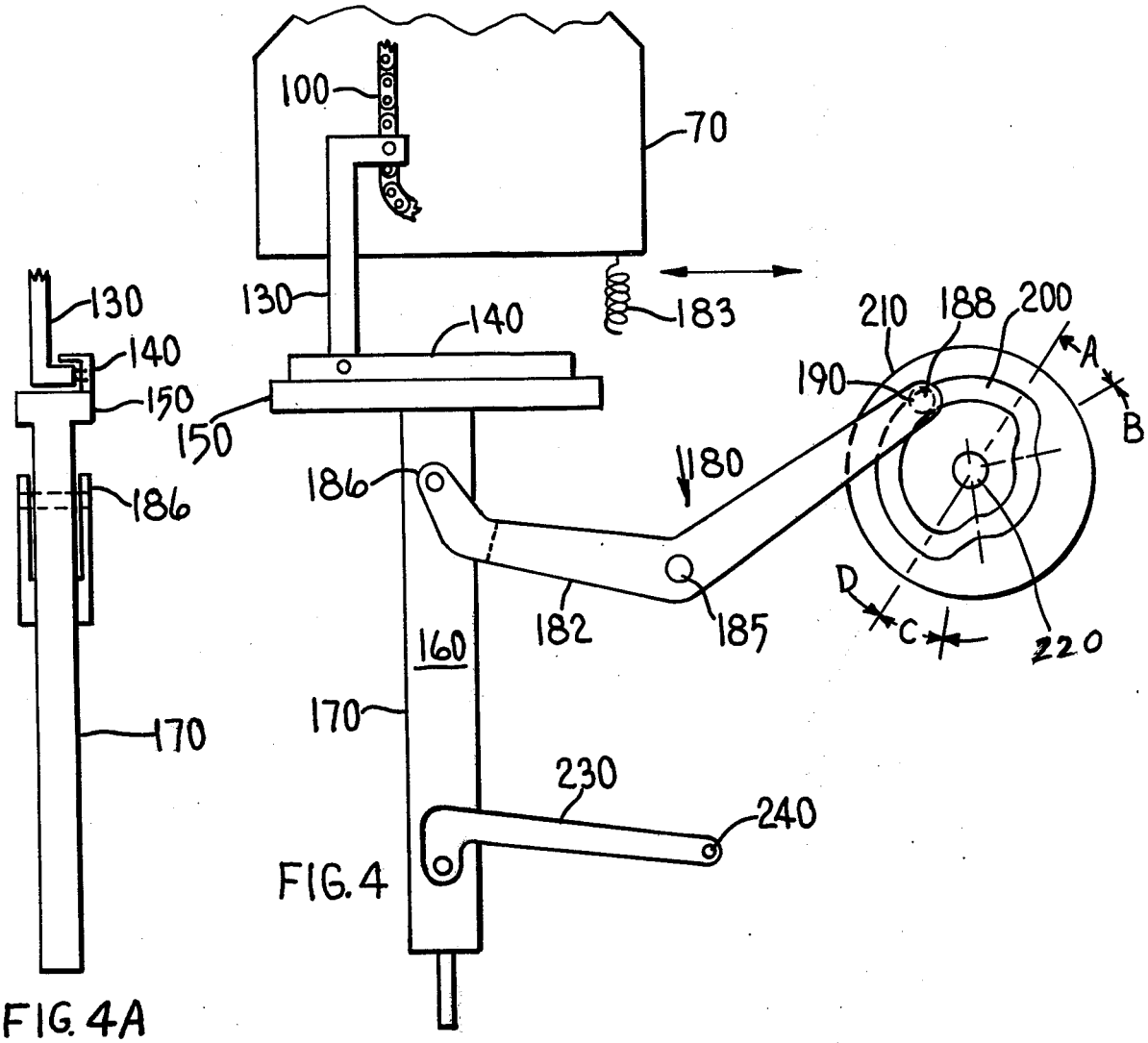
FIG. 4
FIG. 4A
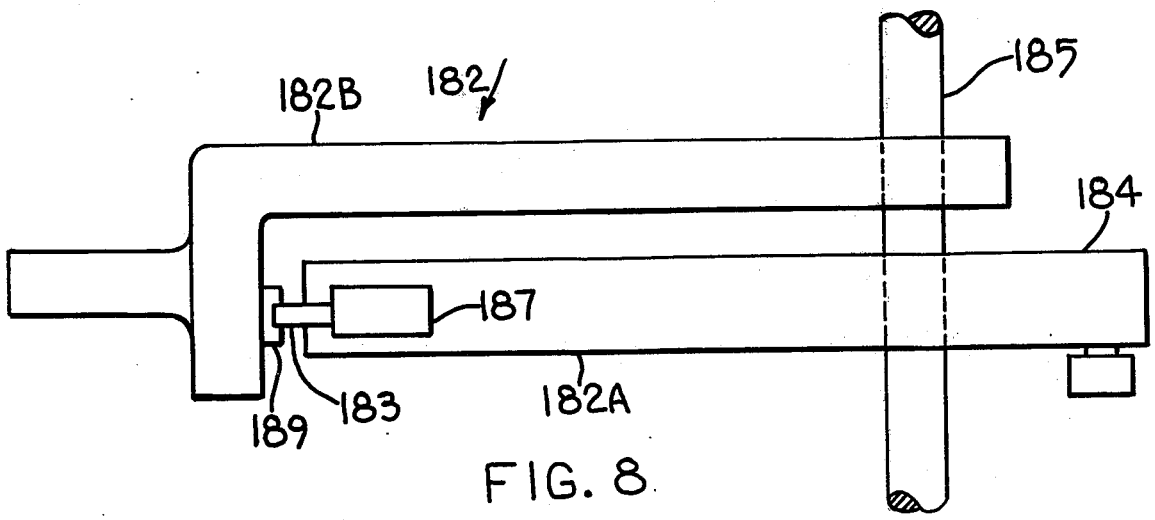
FIG. 8

CONTINUOUS FILM SEALING MACHINE

BACKGROUND OF THE INVENTION

There exists a general type of a high speed, continuous-motion automatic packaging machine known as the horizontal form-fill seal type of machine. Basically, this type of machine forms a horizontal tube of film from a roll of film and feeds product into the tube on a continuous basis in a properly spaced relationship. Each tube is sealed at its ends, and the tubes are cut apart between adjacent products on a continuous basis. To form completely wrapped packages, the transverse sealing and cutting mechanism of these machines generally includes either two mating jaws rotating about a central axis or two mating jaws always aligned vertically but driven in a circular orbit by variable speed crank mechanisms. Inherently in this type of mechanism, the actual type of contact of the seal bar with the film is extremely limited. However, as long as these machines were used with coated cellophane and other rapid-sealing film laminates, the seal dwell time limitation presented no problem. However, with the attempt to adapt this packaging principle and such known apparatus to certain classes of shrink film, specifically irradiated, medium-density polyethylene, it was found that the seal dwell limitation precluded the attainment of the desired range of transverse seal strength.

In addition, in machines of the prior art, the size of products to be packaged, in particular, the height of the package above the operating table was limited.

SUMMARY OF THE INVENTION

The present invention provides improved sealing apparatus wherein sealing members operate vertically and at the same time the assembly which carries these sealing members moves horizontally with the product and the other components of the packaging operation.

DESCRIPTION OF THE DRAWINGS

FIG. 4 is a side elevational view of another portion of the apparatus embodying the invention;

FIG. 4A is a side elevational view of a portion of the apparatus of FIG. 4;

FIG. 8 is a plan view of the apparatus of FIG. 7.

DESCRIPTION OF THE PREFERRED EMBODIMENTS

Figure 1:
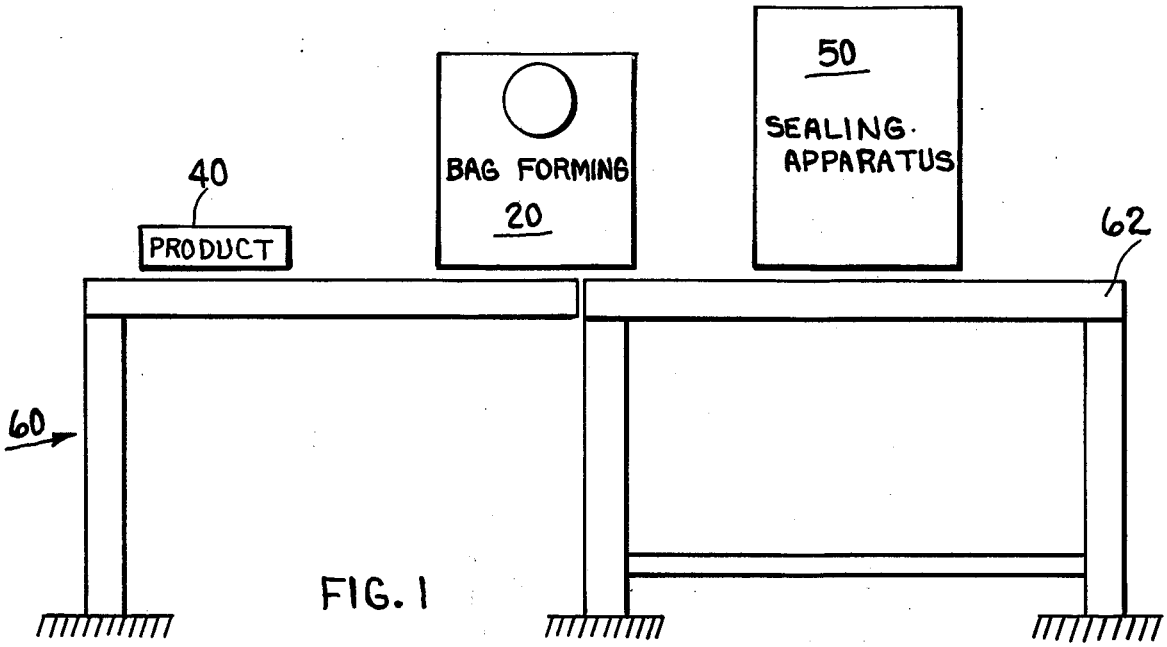
FIG. 1 is a schematic representation of an overall sealing machine embodying the invention.

A continuous bag-sealing machine 10 embodying the principles of the invention includes the usual floor-mounted frame 60 which carries a horizontal operating table 30 and various associated apparatus. The horizontal table includes at the left, as shown schematically in FIG. 1, a horizontal in-feed conveyor belt 34 on which product 40 to be packaged is fed continually to the next operating area at which bag-forming apparatus 20 is located. Apparatus at the bag-forming area includes a roll of film material to be formed into a bag by a plow or other means (not shown). The type of bag which is formed is a tube into which the product is pushed. The tube containing product spaced apart along its length moves to a seal area at which bag-sealing apparatus 50 is provided, and following that is an outfeed conveyor 54. Of course, other apparatus may be provided as required. The present invention is particularly concerned with the bag-sealing apparatus, and this will be described in detail.

The machine 10 operates continuously, that is, the product feeding, film feeding, bag forming and filling, bag sealing, and outfeeding take place continuously and at relatively high speed. According to the invention, in order to permit the filled bag to be properly sealed, the sealing means 50 is operated for a favorable length of time, and this is made possible because it is transported horizontally at the same time that the sealing operation and other operations continue to take place.

Considering the apparatus of the invention more specifically, the frame 60 includes two horizontal side rails 62 and 64 in the sealing area. The sealing assembly includes two vertical side plates 70 and 80 which are spaced apart and are disposed adjacent to the two side rails parallel to each other. Each side plate carries on its inner surface two vertically spaced-apart, aligned sprockets, an upper sprocket 90 and a lower sprocket 92, and chains 100 and 102 are threaded around the pairs of sprockets, one on each pair.

Two horizontal sealing bar assemblies are provided for sealing the bag, there being an upper bar 110 and a lower bar 112. The upper bar 110 is secured at each end to one side of each chain, and the lower bar is secured at each end to the other side of each chain so that, as the chains move in one direction, the bars move toward each other, and, as the chains move in the opposite direction, the bars move away from each other. Vertical guide posts 120 are provided on the side plates, and the sealing bars slide on these guide posts.

A shaft 121 is secured between the upper sprockets and between the lower sprockets.

The various parts are dimensioned so that the sealing bars move the proper distance toward and away from each other when a sealing operation is to be performed and after it is completed.

To produce this vertical movement of the sealing bars, a cam follower 130 in the form of a rod, disposed vertically, is secured at its upper end 132 to one of the chains, chain 100, and its lower end is seated in a horizontal U-shaped track 140 which is secured to the horizontal arm 150 of a T-bar 160, having a vertical arm 170 extending downwardly therefrom. A generally L-shaped lever 180 having a first arm 182 and a second arm 184 is pivotally mounted at its center on a shaft 185 suitably supported on the machine frame. The free end of the arm 182 is pivotally secured to the vertical arm 170 of the T-bar just below the track 140, and the free end 188 of the arm 184 carries a cam follower 190 which is seated in a slot 200 in a cam 210 which is rotatably mounted on a cam shaft 220. The cam shaft 220 is coupled to a motor, not shown. A second bar 230 forms a four-bar linkage for the T-bar and is pivotally coupled at one end to the lower end of the vertical arm 170, and, at its other end, it is pivotally mounted on a shaft 240.

In the track or slot 200 in cam 210, portion A represents the closing phase of the operation, portion B represents the closed phase, portion C represents the opening phase, and portion D represents the full open phase.

In operation of this portion of the apparatus, as the main cam shaft 220 rotates, the cam 210 rotates and the cam follower 190 rides in the track 200 therein. At the same time, the lever 180 pivots about shaft 185, and this causes the T-bar 160 to move up and down. Since the vertical cam follower 130 is secured to the chain 100, vertical movement of the T-bar causes the chain to move, and, as the cam rotates and the T-bar moves up and down, the chain is driven first in one direction, then the other, and the sealing bars move into and out of engagement with each other, all under the control of the track 200 in cam 210.

Figure 3:
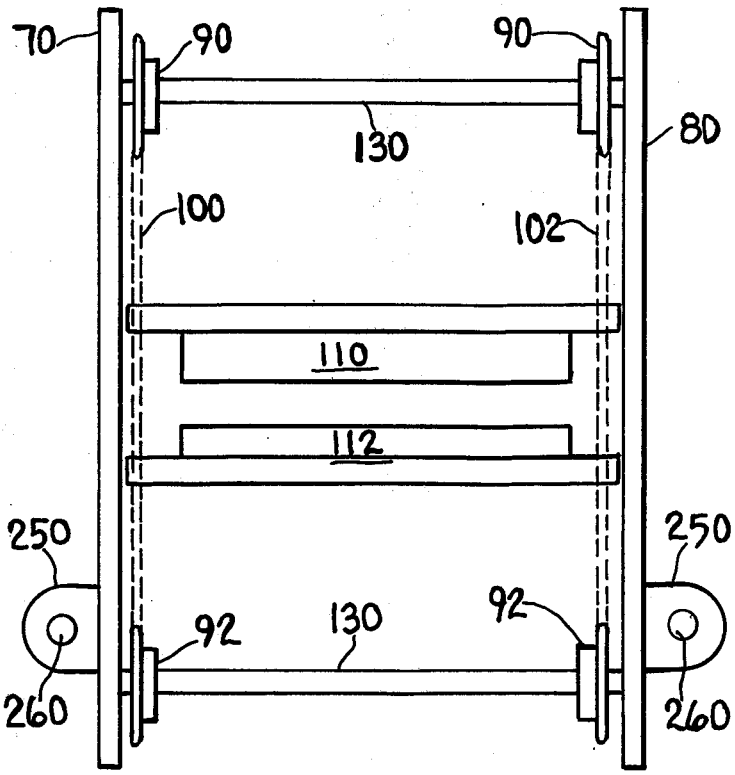
FIG. 3 is a front elevational view of the apparatus of FIG. 2.
Figure 2A:
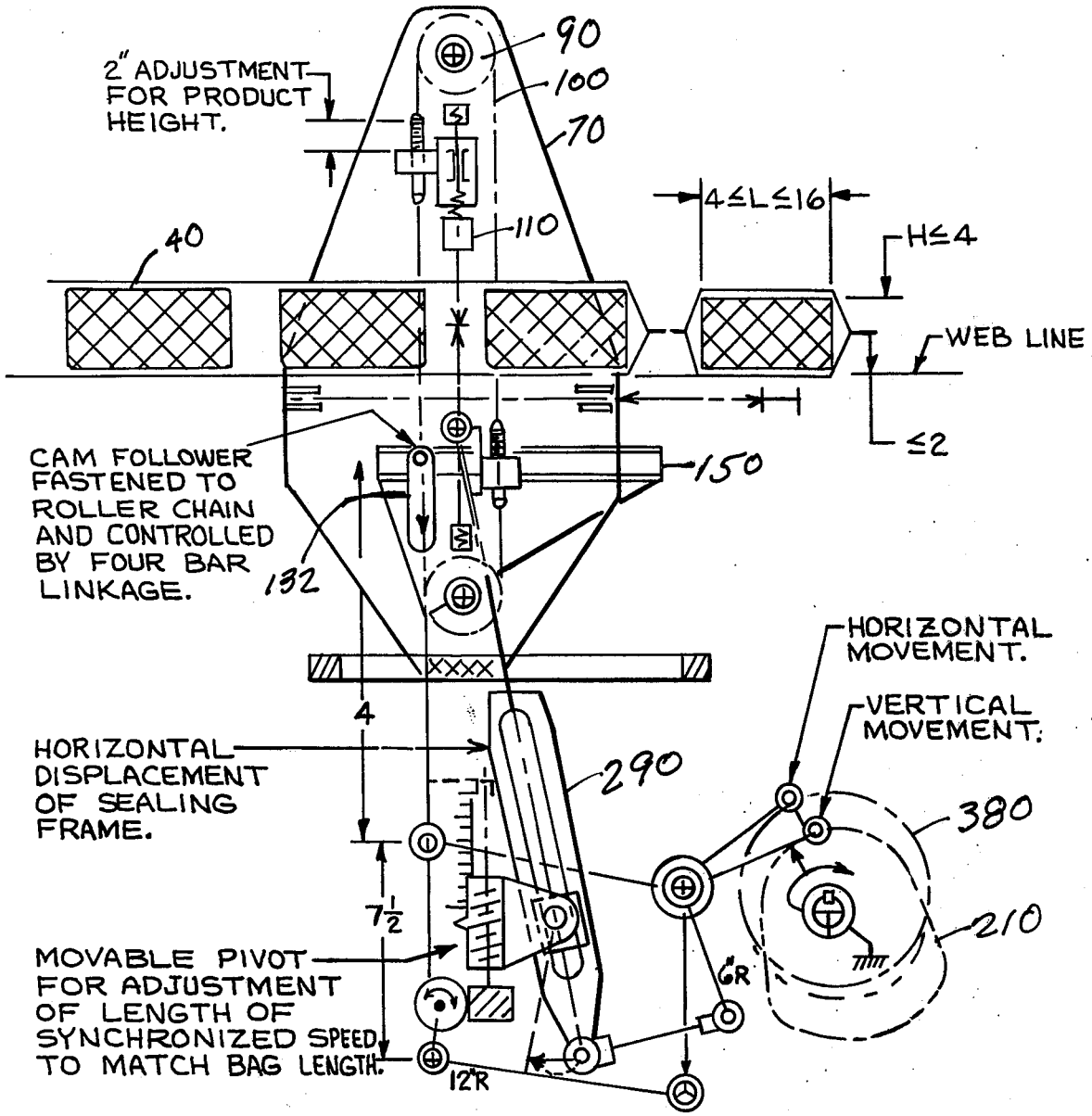
FIG. 2A is a side elevational view of apparatus including the apparatus of FIG. 2.

For horizontal movement of the sealing bar assembly, the two vertical plates are provided on their outer surfaces with bearing blocks 250 (FIG. 3) by means of which the plates are slidably mounted on horizontal shafts 260 secured to the main frame of the machine. A pin 270 (FIG. 5) is secured to the outer surface of one of the plates, and this is seated in a bearing 280 in a generally horizontally oscillating lever 290 which is mounted on a pivot 300 intermediate its ends. The pivot 300 contains linear bearings which allow the lever 290 to move up and down to accommodate length change which results from horizontal oscillation and the fixed anchor 270. The lower end 310 of oscillating lever 290 is pivotally coupled to a connecting rod 320, the other end of which is pivotally coupled to one end of a bar 330 pivoted at its center 340 and having its end 350 provided with a cam follower 360 which rides in an eccentric circular track or slot 370 in a cam 380 which is mounted on the main cam shaft 220.

In operation of this portion of the apparatus, as the main cam shaft 220 rotates, the cam follower 360 riding in the slot 370 in the cam 380 causes lever 330 to pivot, and, through connecting rod 320, it causes the oscillating lever 290 to oscillate back and forth about the pivot point 300, and this lever, acting through the pin 270 secured to the plate 70, causes the plate and all of the sealing bar assembly to move back and forth horizontally.

Figure 2:
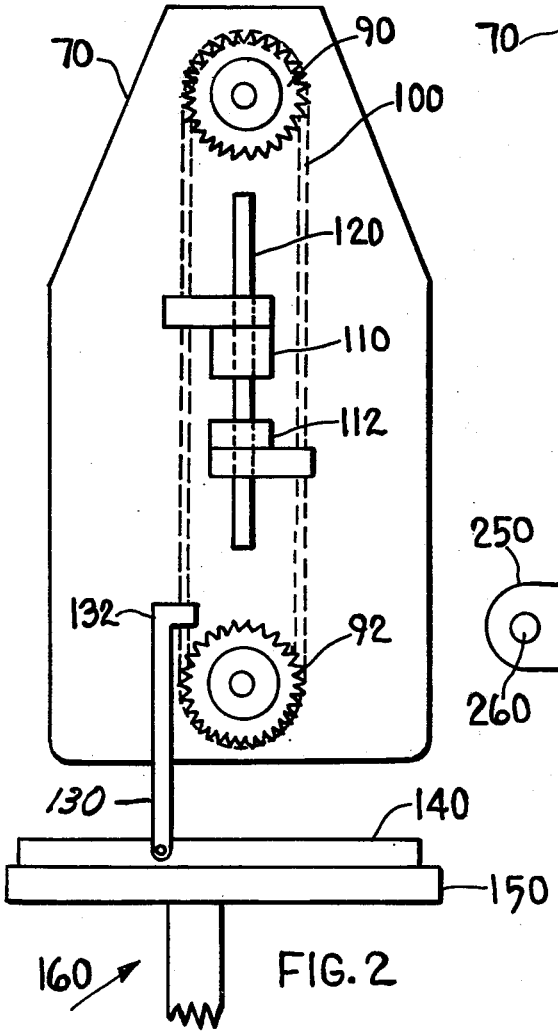
FIG. 2 is a side elevational view of a portion of the apparatus of FIG. 1A.

It is noted that, as the assembly moves horizontally, the cam follower 130 (FIG. 2) slides in the horizontal track 140 on the T-bar 160 to permit it to perform its function of generating vertical movement of the sealing bars even though the assembly is moving horizontally.

Adjustment of the angle of oscillation of the oscillating lever 290 and the length of the horizontal path of travel of the sealing assembly is achieved by means of vertical adjustment of pivot 300 in a slot 302 in the oscillating lever. It can be seen that the position of this pivot point controls the length of the path traversed by the upper end of the lever 290. This adjusting apparatus is suitably supported on the frame of the machine 10, and it can be manipulated while the machine is running to adjust the length of the horizontal path of travel.

Figure 5:
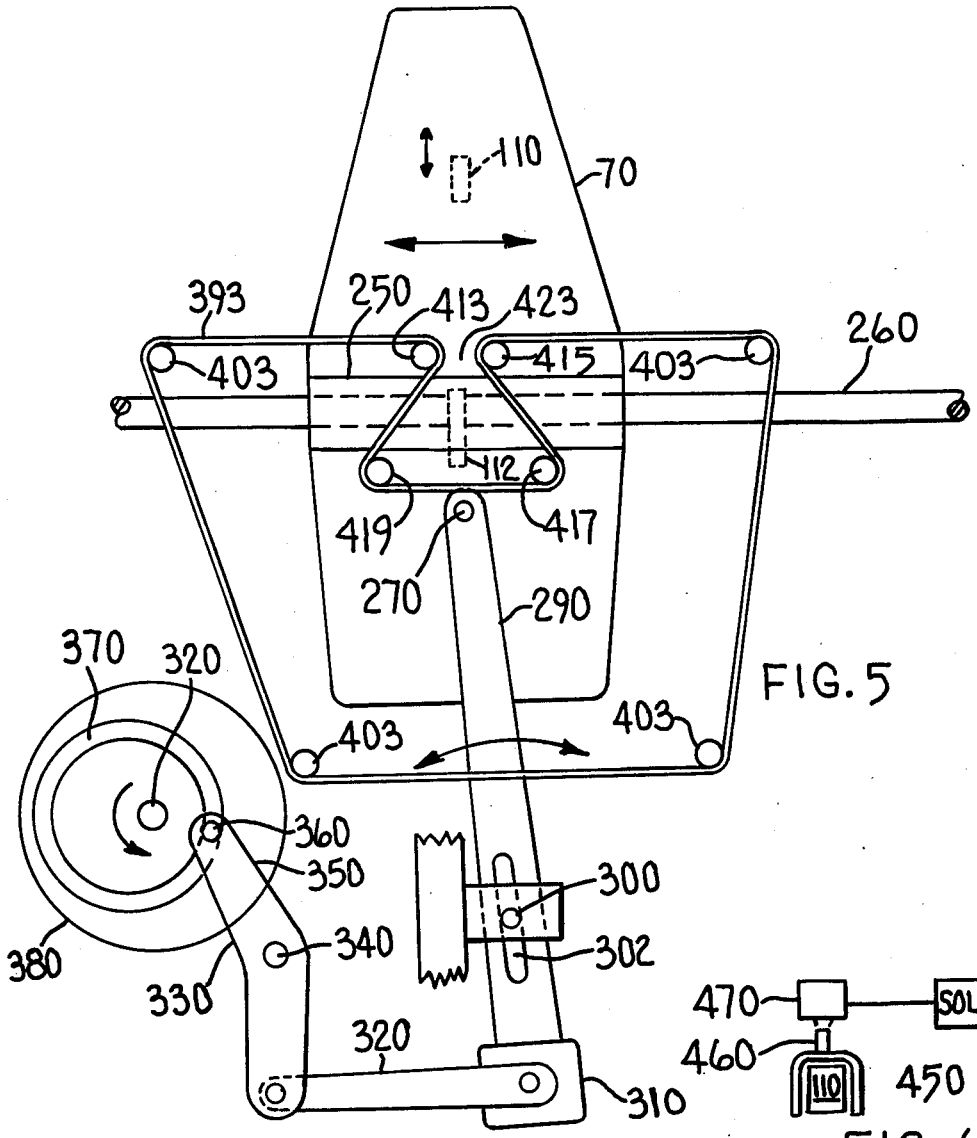
FIG. 5 is a side elevational view of another portion of the apparatus of the invention.

The portion of the table associated with the sealing apparatus is shown schematically in FIG. 5. The conveying means comprises a plurality of cables or ropes 393 which are threaded on four fixed rollers 403 disposed at the corners of a rectangle and by means of which the cables are driven to the right to move bagged product in that direction. In addition, an assembly of four auxiliary rollers 413, 415, 417, and 419 are provided disposed at the corners of a second smaller rectangle within the first rectangle, and the cables extend over the upper left roller 413, under the lower rollers 417 and 419, and over the right upper roller 415. The four auxiliary rollers are so mounted that they can be driven horizontally back and forth along with the sealing bar assembly. In addition, the two upper rollers 413 and 415 are spaced apart to provide a space 423 in which the lower sealing bar 112 is positioned.

Figure 6:
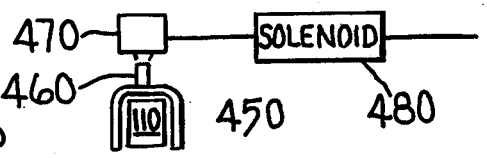
FIG. 6 is a side elevational view and a schematic representation of a portion of the apparatus of the invention.
Figure 7:
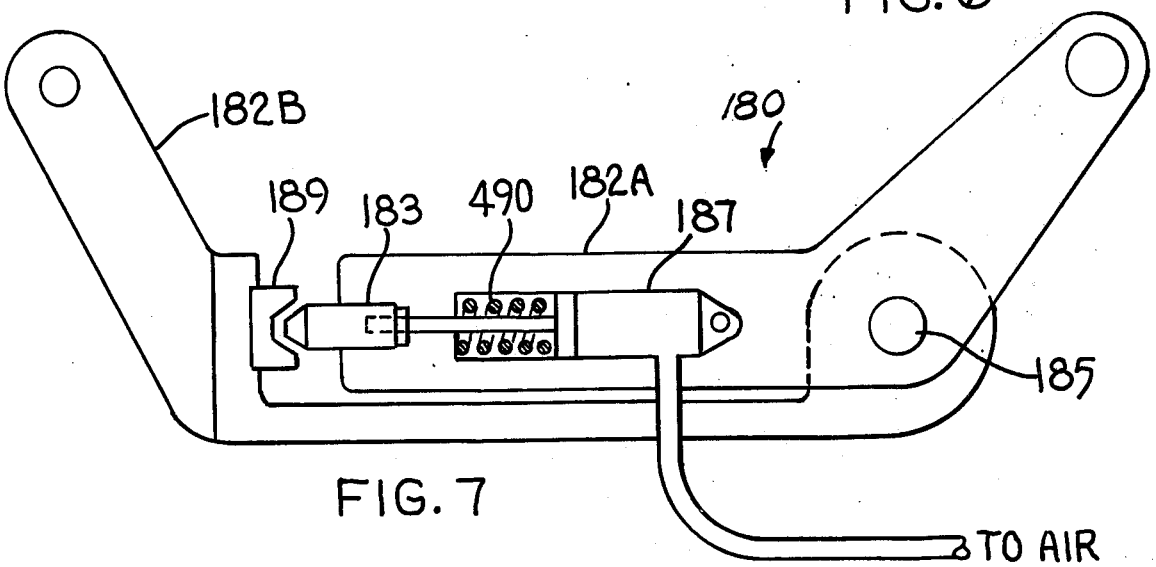
FIG. 7 is a side elevational view of a portion of the apparatus of the invention.

A safety mechanism (FIG. 6) is provided in case a foreign body or a product finds itself between the sealing bars 110 and 112 as they come together and it is desired to stop the sealing mechanism from functioning. This safety mechanism includes a U-shaped plate 450 slidably mounted on the upper sealing bar 110 and carrying on its upper surface a post 460 aligned with a normally closed switch mechanism 470 mounted on a plate disposed above the upper sealing bar and movable with the upper sealing bar. The switch mechanism 470 is coupled to a solenoid 480 which controls the flow of air to the air cylinder 187 described below. In addition, the first arm 182 of the lever 180 is made up of two arms 182A and 182B coupled together, with both arms pivoted on shaft 185 and with the inner arm 182A coupled to the outer arm 182B by means of the piston 183 of air cylinder 187 mounted in the inner arm and having its piston extending out of the front end of the inner arm and locking with a U-shaped plate 189 provided on the outer arm 182B, so that both are locked together as long as the machine is operating properly in the safe condition and air is present to maintain the air piston extended. When a foreign body is present between the sealing bars, the plate 450 is pushed up, causes the switch 470 to open, and this de-energizes the solenoid valve 480 which removes air from the air valve 187 and permits the spring 490 therein to retract and disengage the two arms 182A and 182B whereby the sealing mechanism is disabled. Spring 183 pulls down T-bar 160.

In the overall operation of the machine 10, product to be bagged moves horizontally along the table and is pushed into a formed, tubular bag which moves into the seal area. The sealing bars 110 and 112 are brought down, and heat is provided to begin formation of the seal, and simultaneously the seal support apparatus, including the side plates and all associated apparatus, moves horizontally. After the seal has been formed and after a period of time determined by the various mechanical components and particularly the cam 210, the sealing bars open and the seal assembly travels in the reverse direction to the starting position so that it can perform the sealing operation again. Meanwhile, the sealed tube is fed out of the machine, and the undividual packaged products are cut apart.

Various advantages of the invention will appear to those skilled in the art. The advantage of a relatively long seal time, which is provided, is immediately apparent. But, in addition, because of the vertical motion of the sealing bars with respect to the product, the product may have a wide range of sizes, especially in its height above the support table or conveyor.

What is claimed is:

1. Film-sealing apparatus comprising a generally horizontal table including a product infeed area, a film supply, means for forming a bag from the film, the product being fed into said bag along a horizontal path, and sealing apparatus positioned to receive said bag and seal said bag, said sealing apparatus including vertically aligned movable sealing members adapted to receive between them portions of the bag to be sealed, said apparatus including means for moving said sealing members into and out of sealing engagement with said bag between them, said apparatus including means for simultaneously moving said sealing members horizontally while they perform a sealing operation, said sealing apparatus further including a pair of plates spaced apart and disposed parallel to each other and parallel to said horizontal path, a first pair of sprockets vertically aligned on the inner surface of said first plate facing said second plate, and a second pair of sprockets vertically aligned on the inner surface of said second plate and facing said first plate, corresponding sprockets of said first and second pairs being horizontally aligned, a first chain threaded on said first pair of sprockets, a second chain threaded on said second pair of sprockets, a first sealing bar extending across the space between said pairs of sprockets, disposed horizontally, and secured to one portion of each chain which travels in one direction when said sprockets are driven, and, a second sealing member extending across the space between said plates, disposed horizontally, and secured to the opposite portion of each of said chains which travels in the opposite direction in which said sprockets are driven.

2. The apparatus defined in claim 1 and including a rod-like cam follower secured to one of said chains and coupled to mechanical means for driving said cam follower and the portion of the chain to which it is attached vertically up and down.

3. The apparatus defined in claim 2 wherein said cam follower has one end secured to a portion of one of said chains, and the opposite end is slidably mounted in a horizontal track coupled to said mechanical means.

4. The apparatus defined in claim 3 and including a cam mounted on a cam shaft and having a slot, a lever pivoted about its center and having one end seated in said slot in said cam and the other end pivotally coupled to said track whereby, as said in cam rotates, said lever pivots and drives said cam follower and said chain and said sealing members toward and away from each other.

5. Film-sealing apparatus comprising means providing a horizontal path along which a tube containing a series of products progresses to a sealing station for sealing each of said products in its own tube, the apparatus at said sealing station comprising first and second sealing bars disposed horizontally transverse to said path, sprocket means and chain means secured to said first and second sealing bars whereby movement of said sprocket and chain means in one direction drives said sealing bars together, and movement of said sprocket and chain means in the opposite direction drives said sealing bars apart, said sealing bars being driven vertically up and down, and means rigidly coupling said chain means to a vertically reciprocable member which is coupled itself through a linkage to a cam whereby said vertically reciprocable member can be driven up and down and said sealing bars can be driven up and down.

6. The apparatus defined in claim 5 and including a linkage secured at one end to one of said plates and coupled to a cam whereby rotation of the cam drives said one plate and the assembly of sealing bars back and forth horizontally along said path.

7. The apparatus defined in claim 6 wherein said linkage includes an arm comprising first and second members wherein said first member includes a reciprocable shaft which can be engaged or disengaged from said second member, an air cycle coupled to said first member, and switch means mounted on said sealing bars coupled to the supply of air for said air cylinder whereby operation of said switch means separates said first and second members and disables said apparatus.

* * * * *